US009076328B2

(12) United States Patent
Kondo

(10) Patent No.: US 9,076,328 B2
(45) Date of Patent: Jul. 7, 2015

(54) ACOUSTIC GUIDING SYSTEM

(76) Inventor: Mamoru Kondo, Tokyo (JP)

( * ) Notice: Subject to any disclaimer, the term of this patent is extended or adjusted under 35 U.S.C. 154(b) by 138 days.

(21) Appl. No.: 13/985,464

(22) PCT Filed: Feb. 16, 2012

(86) PCT No.: PCT/JP2012/053681
§ 371 (c)(1),
(2), (4) Date: Aug. 14, 2013

(87) PCT Pub. No.: WO2012/111760
PCT Pub. Date: Aug. 23, 2012

(65) Prior Publication Data

US 2013/0321175 A1 Dec. 5, 2013

(30) Foreign Application Priority Data

Feb. 16, 2011 (JP) ..... 2011-030799

(51) Int. Cl.

| | |
|---|---|
| ***G08B 3/10*** | (2006.01) |
| ***G08G 1/005*** | (2006.01) |
| ***H04R 3/12*** | (2006.01) |
| *H04R 27/00* | (2006.01) |

(52) U.S. Cl.
CPC ..... *G08G 1/005* (2013.01); *H04R 3/12* (2013.01); *H04R 27/00* (2013.01)

(58) Field of Classification Search
CPC ..... A61H 3/061
See application file for complete search history.

(56) References Cited

U.S. PATENT DOCUMENTS

| | | | | |
|---|---|---|---|---|
| 4,660,022 | A * | 4/1987 | Osaka | 340/384.3 |
| 6,964,244 | B2 * | 11/2005 | Stockton | 116/205 |
| 2005/0124376 | A1 * | 6/2005 | Wu et al. | 455/550.1 |
| 2007/0190881 | A1 * | 8/2007 | Shibaoka et al. | 442/228 |
| 2010/0109918 | A1 * | 5/2010 | Liebermann | 341/21 |
| 2013/0200992 | A1 * | 8/2013 | Kim | 340/4.11 |

FOREIGN PATENT DOCUMENTS

| | | | |
|---|---|---|---|
| JP | 5135286 | A | 6/1993 |
| JP | 7262461 | A | 10/1995 |
| JP | 2000123281 | A | 4/2000 |
| JP | 2000285378 | A | 10/2000 |
| JP | 2001229485 | A | 8/2001 |
| JP | 2002356820 | A | 12/2002 |

(Continued)

OTHER PUBLICATIONS

International Search Report for International Application No. PCT/JP2012/053681; Date of Mailing: Mar. 27, 2012, with English Translation.

(Continued)

*Primary Examiner* — Van Trieu
(74) *Attorney, Agent, or Firm* — Cantor Colburn LLP

(57) ABSTRACT

An acoustic guiding system of this invention comprises: an n-phase signal wiring which contains n wire lines and a common ground where n is an integer larger than or equals to three; a sound source which generates an electric current for a signal sound; a distributer which distributes the electric current from the sound source to each line of the n-phase signal wiring repeatedly; a controller which controls the signal sound in accordance with signal information required for traffic control or the like; and speakers connected to each line of the n phase signal wiring in the order of the phase number.

4 Claims, 7 Drawing Sheets

(56) References Cited

FOREIGN PATENT DOCUMENTS

| | | | |
|---|---|---|---|
| JP | 2003288671 | A | 10/2003 |
| JP | 2005232923 | A | 9/2005 |
| JP | 2006295285 | A | 10/2006 |
| JP | 2006340159 | A | 12/2006 |
| JP | 2008040685 | A | 2/2008 |
| JP | 2008518314 | A | 5/2008 |

OTHER PUBLICATIONS

"Positive refuge guide system technology standard", JIL5505-1993, p. 1 and p. 7, established on Aug. 12, 1993 by Japan lighting appliance; 12 pages in Japanese.

* cited by examiner

ACOUSTIC GUIDING SYSTEM

CROSS REFERENCE TO RELATED APPLICATIONS

This is the U.S. national stage of application No. PCT/JP2012/053681, filed on 16 Feb. 2012. Priority under 35 U.S.C. §119(a) and 35 U.S.C. §365(b) is claimed from Japanese Application No. 2011-030799, filed 16 Feb. 2011, the disclosure of which is also incorporated herein by reference.

TECHNICAL FIELD

The present invention relates to a system for guiding pedestrians, such as visually impaired people, walking on a road or crossing safely by only their ears.

BACKGROUND ART

A known crosswalk audio signal apparatus provided as an auxiliary apparatus for a traffic signal notifies the traffic signal being green by an audio signal from a speaker so that a visually impaired person is allowed to cross the road safely (as shown in LTL 2). For example, if there are two crosswalks at a crossroad, one is in the south-north direction and the other is in the east-west direction, a speaker at the south-north crosswalk outputs a sound "cheep" and a speaker at the east-west crosswalk outputs a sound "cuckoo" during each crosswalk is allowed to walk to notify the pedestrian signal is green. However, the difference of the sounds "cheep" and "cuckoo" is not enough to notify a pedestrian the real direction and location of the crosswalk for safe crossing guide, and several guiding system have been proposed to solve this problem.

For example, tactile blocks with notification protrudes such as Braille are embedded in a line on a road surface and light emitting bodies are provided on a part of the tactile blocks so that a pedestrian is able to know the location he/she standing by stepping on the blocks and that a person with low vision can capture information about a pathway, steps or the like by receiving light from the light emitting bodies. However, such light emitting bodies are not helpful for a person with complete blindness. The acoustic system with combination of plural number of speakers as shown in PTL 3 can notify pedestrians the location and direction of the route from the start point to the end point and dangerous area boundaries to smoothly cross a crosswalk. Impaired pedestrians can get a large freedom to walk freely. But this technology was not economical to solve the problem, because the structure and usage of the combination of speakers was not systematic for a long distance route. The present invention provides an acoustic guiding system using a multi-phase signal line to give the location and direction information of the route.

CITATION LIST

Patent Literature

PTL 1: JP 7-262461 A
PTL 2: JP 2000-123281 A
PTL 3: JP 2000-285378 A
PTL 3: JP 2001-229485 A
PTL 5: JP 2002-356820 A
PTL 6: JP 2003-288671 A
PTL 7: JP 2005-232923 A
PTL 8: JP 2008-040685 A

PTL 9: JP 2008-518314 A
PTL 10: JP 5-135286 A

Non Patent Literature

NPL1: "Positive refuge guide system technology standard", JIL5505-1993, P1 and p7, established on Aug. 12, 1993 by Japan lighting appliance

SUMMARY OF INVENTION

Technical Problem

Prior art for guiding a visually impaired person by his/her auditory sensation is disclosed in PTL 1 to PTL 10. When a guiding sound source is placed at a fixed position on the road, like a traffic light at a crossroad for instance, a pedestrian can get the direction of the sound and can know the road direction and positional relation between the pedestrian and the road. In contrast to this, technologies disclosed in PTL 5, PTL 6 and PTL 9 are useless to get the direction, because the sound source is in a portable device carried by the pedestrian and the point producing sound is not fixed. In PTL 7, the sound is always generated at the foot of the pedestrian and is useless to know the direction.

The rest, PTL 1 to PTL 4, PTL 7 and PTL 8, use an acoustic signal that gives direction information. At a crossroad equipped with acoustic signals, the direction of the crosswalk and whether it is permitted or not are notified to pedestrians. However, a visually impaired pedestrian may lose the direction on the way to take another path if the given information is only direction information at individual points. There are two kind ways of traffic control at a road under construction or a temporary control case for pedestrians without impairment; one is to allocate a traffic control person waving a flag and another is that the traffic control person leads the pedestrian carrying a flag through the path. But the latter is rarely used as it is costly. For a visually impaired pedestrian, however, it is more reliable to be lead through the path using an acoustic signal instead of a waving flag. The present invention provides an economical signal system for acoustic guiding through the path and helps visually impaired people to walk safely. To prevent a fall accident at a platform of a train station, a close range guiding signal is necessary seamlessly from one end to the other end of the whole path.

PTL 1 and NPL 1 provide guiding systems each of which gives direction of the path making a sound image by combination of plural number of speakers. It uses the precedent sound effect or Haas effect. In this system, the time difference is given to adjacent speakers to make the direction of sound source to be felt. The time difference is smaller than one tenth second and makes a pedestrian hear the sound in an instant to feel the direction. The sign of the difference is opposite to that in the present invention.

The systems in PTL 2, PTL 4 and PTL 8, are made with a smaller number of speakers than in the present invention system and they show the direction of the path to take at local points.

PTL 3 provides a guiding system named "a sound source device network" in which a device called "node" is installed on a road or in an amusement park to shows the direction of the path by a combination of sound sources. The sound image in this method is to make a person sense the direction by a combination of sounds from plural number of sound sources. The node corresponds to the flag waving traffic control person above. The control of all the system is performed by combining the nodes arbitrarily as needed. However, systematic control is required for guiding a person throughout a continuous path.

Since the system in PTL 10 lacks systematic control as that in PLT 3 does and it does not use n-phase signal lines in the present invention, it differs from the present invention in the configuration of hardware and software, and in the effect. Though an embodiment in PTL 10 may be similar to the present invention in using 3-phase signal lines and giving delay to the signal, each signal line is connected only one speaker. Therefore, the method is inefficient compared to the present invention method in which a plural number of speakers are used in each phase. Moreover its use becomes impossible when the guide distance becomes longer, because pulse width period denoted "a" in the document becomes shorter as it decreases in inverse proportion to the guide distance.

Solution to Problem

The present invention provides a system which guides any route from the start to the substituting a person carrying flag with a series of singing birds flying along the route. In the system, a plural number of speakers are installed periodically along the route and produce signal sound repeatedly to imitate the series of flying and singing birds along the route so that a pedestrian may be notified of a whole route and direction of the walking range and the positional relationship between a dangerous place and the pedestrian.

To make the system in which as if singing birds guide the pedestrians, a wave of an acoustic signal is formed over the whole of the one dimensional route. This wave is not a sound wave but a wave of sound producing points which move along the route. The sound wave moves at the speed of sound but the wave of signal producing points moves at the speed of birds. The wave generally is a periodical vibration of which the waveform travels through place. In the case of the wave of the signal producing points, it travels through the route and a singing bird is at every crest of the wave. To produce signal sounds imitating a bird flying along the route, speakers A, B, C, D produce signal sounds imitating a bird song only at the timings that the bird flown past each speaker. The location where the sound is produced moves by exchanging the speaker that produces the sound by turns in the order A, B, C, D. When the bird goes to the route E, F, G, H, next bird follows and flies on the route A, B, C, D at the same timings. It is also repeated periodically after that. As described above, the present system can notify a pedestrian of a general direction of a walking range and a positional relationship by making sound producing points of the fixed speakers move in sequence along the route.

For making a signal advance in a wavelike form like a bird flying, well-known polyphase AC wiring is adopted to flow a signal current. For example, in a three phase AC wiring which is now practical for a high voltage power wiring, a sine wave current flows in each of 3 lines in the wiring. The three sine waves have a same wave form and have a phase difference of 120 degrees between them. Generally a periodical signal comprises a sinusoidal fundamental wave and harmonics. The three signal currents flowing into this system have a same wave form with a fundamental wave being shifted 120 degrees each other. As the signal current is not a simple sine wave but it has much harmonic wave components, the common ground line is necessary to be added. Therefore, four lines are required for a three-phase wiring. If the number of phases is an integer n, an n-phase signal wiring is consist of n+1 lines, that is each of n phase lines plus one ground line, and the current flowing in each phase has a same fundamental wave with a phase difference of 360 degrees/n between them. By such an n-phase signal wiring, the signal wave having a period T moves at a speed of birds when n is larger than 3. The second phase signal current is made from the first phase signal current by given a delay of T/n, and the third phase current from the second and so on. The number of phase n is assumed to be 4 in the explanation below.

To make the signal sound occurring position move periodically, the speakers are divided into 4 phases (A and E, B and F, C and G and D and H) and connected to respective lines, and a signal wiring comprising these lines and a common ground is wired along the route. Then, each of the speakers can produce a sound at the necessary timing by setting time difference between the acoustic signals for each of the phases and sending those signals to the wires. This wiring method is that of the multi-phase alternating current. The general direction of the range in which the pedestrian is to walk, and the positional relationship to areas can be notified to the pedestrian by the signal song imitating a series of flying birds. As the pedestrians vary in walking speed and may occasionally stop. When the bird speed is set at a little faster than the pedestrian speed, the bird will pass over the pedestrian and may leave him/her, but the bird at the next wave top comes near and guides him/her continuously.

Advantageous Effects of Invention

The present invention provides a guiding system for a visually impaired person wherein the person is necessary simply to follow the singing birds signal over all the range of the crosswalk from the start to the end. The system can notify the direction of the road and the positional relationship between dangerous area and the pedestrians, and safe guiding of the crossing is made. In the guiding system for a pedestrian to follow the signal sound, the speed and the direction of the signal sound should not make a big change or a break on the way. By the present system, guiding with a continuous signal wave speed is made. This system has an advantage to keep the signal loudness relatively low because the pedestrian is necessary to hear the signal sound from the speakers near to him/her. It decreases the environmental noise problem with the adjacent area.

In addition to this, the pedestrian does not need to carry any devices for receiving the sound signal. As the main part of this system is the wiring with speakers except some electronic apparatus in the control package, setting up the system is easy with small cost.

In the conventional technology system with the repetition of speakers ABCD and ABCD, there was an abrupt discontinuity at the juncture from D to A. The present system is seamless and has no discontinuity. This system is applicable to guiding system for many indoor and outdoor facilities. If this system is placed in the street, the visually impaired people get a large freedom of activity.

BRIEF DESCRIPTION OF DRAWINGS

FIG. 4 shows times and positions when and where the speakers installed along the signal wiring produce a signal sound. The horizontal axis shows the distance on the crosswalk from the start. The route length is 10 m. The vertical axis shows the time from the pedestrian to start crossing. The vertical axis also shows the time of acoustic signals being generated from phase #1 at phase #1 to #4. The time delay t between phases is 0.5 s. The circle shows the point of time and distance producing the signal sound. The broken arrow line from the origin to right upper end shows the track of a pedestrian walking at a constant speed of 2 m/s.

FIG. 9 shows a condition of the signal sound at the green signal side on crossroads P at the second street being green and also shows a condition of the signal sound at the green signal side on crossroads Q at the second street being red and therefore at the second avenue being green. The signal wirings in the roads except crossroads, denoted by the black arrow, generate a signal sound always allowing for pedestrians to pass through along the arrow direction. The signal sound may include the street or avenue name.

DESCRIPTION OF EMBODIMENTS

Embodiment 1

Figure 1:
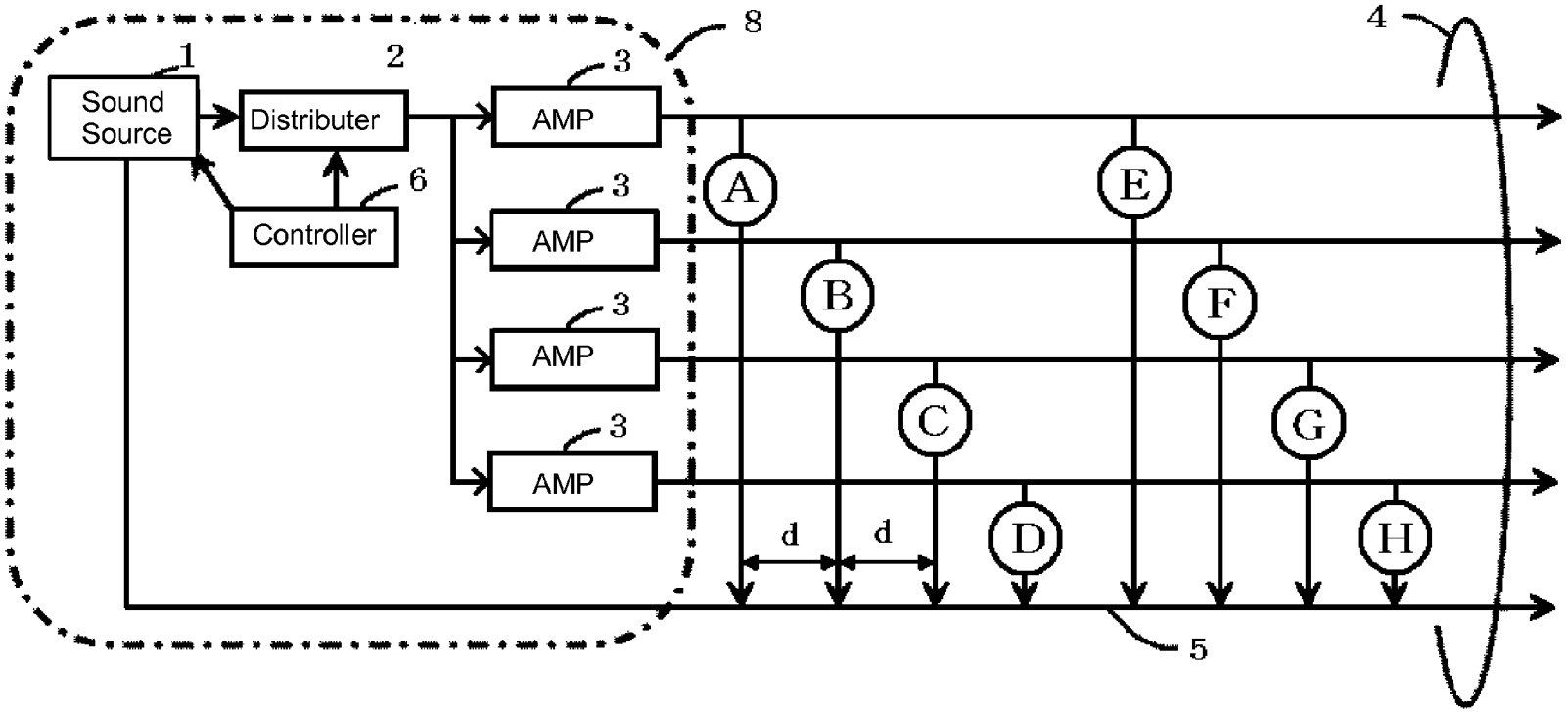
FIG. 1 is a block diagram showing a circuitry configuration of an acoustic guiding system according to this invention comprising: a sound source 1, distributer 2, amplifiers 3, signal wirings 4, a common ground 5, a controller 6, speakers 7 in each phase of A to H. The signal wiring 4 is a bunch of the lines connecting speakers 7 in each phase and a common ground. Control package 8 contains a sound source 1, a distributer 2, amplifiers 3 and a controller 6 in a package

FIG. 1 is a block diagram showing a circuit of an acoustic guiding system in the present invention.

In this acoustic guiding system, a sound source 1 generates a sound signal repeatedly in the same wave form with a time delay of about 0.5 s. a distributer 2 gives the signals at the necessary timings to each of amplifiers 3 from the phase #1 to phase #4 and they are supplied to 4 lines in a signal wiring (the number of phase is 3 to 5 preferably). The signal wiring 4 which consists of the 4 lines and a common ground line 5 is placed over all the route of a crossroads. Speakers A, B, C, . . . ,H are connected in the order of the phase number to each of the four lines with a spacing d between the speakers. Then the speakers A, B, . . . produce the same signal sound one by one, from the phase #1 to the phase #4. As the sound producing place changes by d=1 m, the produced sound is felt as if an object is moving at a speed of v=d/t=2 m/s. After the phase #4, the phases #1 to #4 again produce the sound repeatedly. When the sound "cheep" is used, which is often used at crossroads, the sound is felt as if a series of cheeping bird were flying along the wiring route, at a speed of 2 m/t. The flying speed v can be regulated by adjusting the spacing d or delay time t.

The controller 6 receives information that the crossroads is permitted to walk, then selects the bird song "cheep" or "coo-coo" corresponding to the instruction, and sends the selection pulse to the sound source with the timing clock pulse. The controller 6 sends the instruction also to the distributer 2 to supply the signal sound to each phase line.

Figure 2:
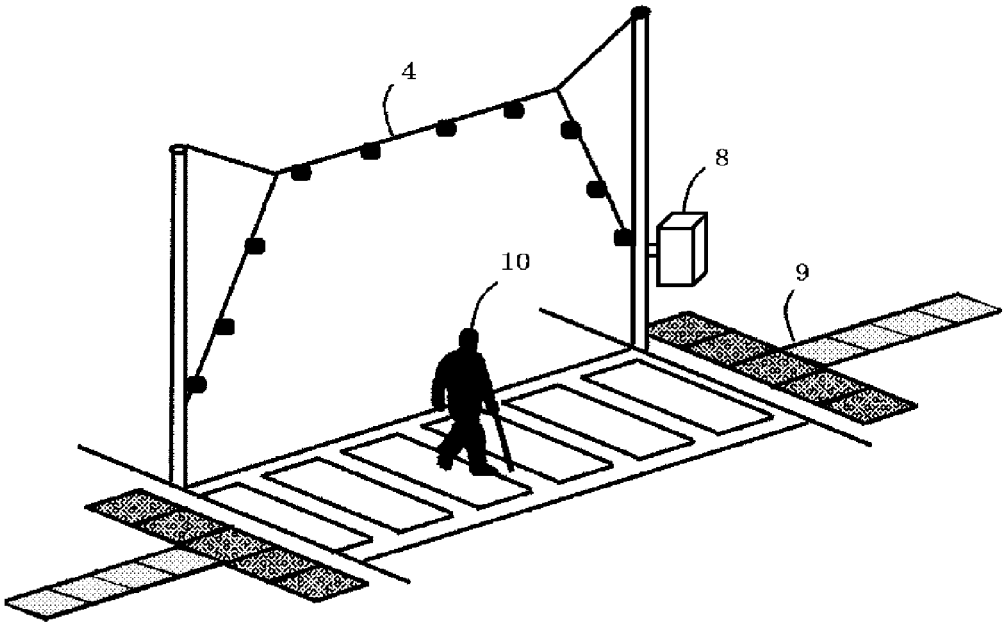
FIG. 2 is a bird's-eye view showing a pedestrian crossing that has a present invention. The signal wiring set up above pedestrians is hanged down at both sides.

FIG. 2 shows the signal wiring 4 placed at a crosswalk. The black dots on the wiring are speakers 7. The sound source 1, the distributer 2, the amplifiers 3 and the controller 6 are contained in a control package 8.

As the signal wiring 4 is wired over the crosswalk, the pedestrian can cross the crosswalk by following the bird passing over the head. As the height of setting the signal wiring is made low and the distance d between speakers is decreased at the end of the crosswalk, the pedestrian feels the move of the bird decreasing the speed and landing to the crosswalk end. This acoustic guiding system is placed as a part of a traffic control system with red, green and yellow light signal. The signal sound to walk or not to walk is necessary to be synchronized with the signal light. The control for this purpose is made by the controller 6. If the signal light is red, a sound "chirrup" is used and the time difference t between the phases is set to "0", the birds keep staying and chirping. The operation of the system is explained later.

Figure 3:
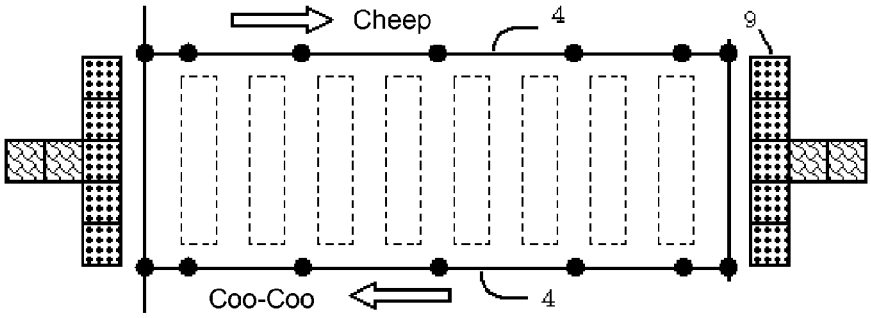
FIG. 3 is a plan view showing a crosswalk that has a present invention system. There are two signal wiring at the upper and lower ends and the black dots denote speakers. A signal wiring denoted by the arrow pointing right shows that the points producing sound "cheep" moves to right. A signal wiring denoted by the white arrow shows that the wave of the points producing sound "coo-coo" moves to left.

FIG. 3 is a plan view showing a crosswalk wherein there are two signal wirings at the upper and lower ends. The black dots on the wirings are speakers. The white arrow pointing right on the upper wiring shows that the wave of the points that produces the sound "cheep" moves to right and the white arrow pointing left on the lower wiring shows that the wave of the points that produces the sound "coo-coo" moves to left. Thus the guiding system can notify the direction all over the crosswalk to the pedestrian using sound signal.

Figure 4:
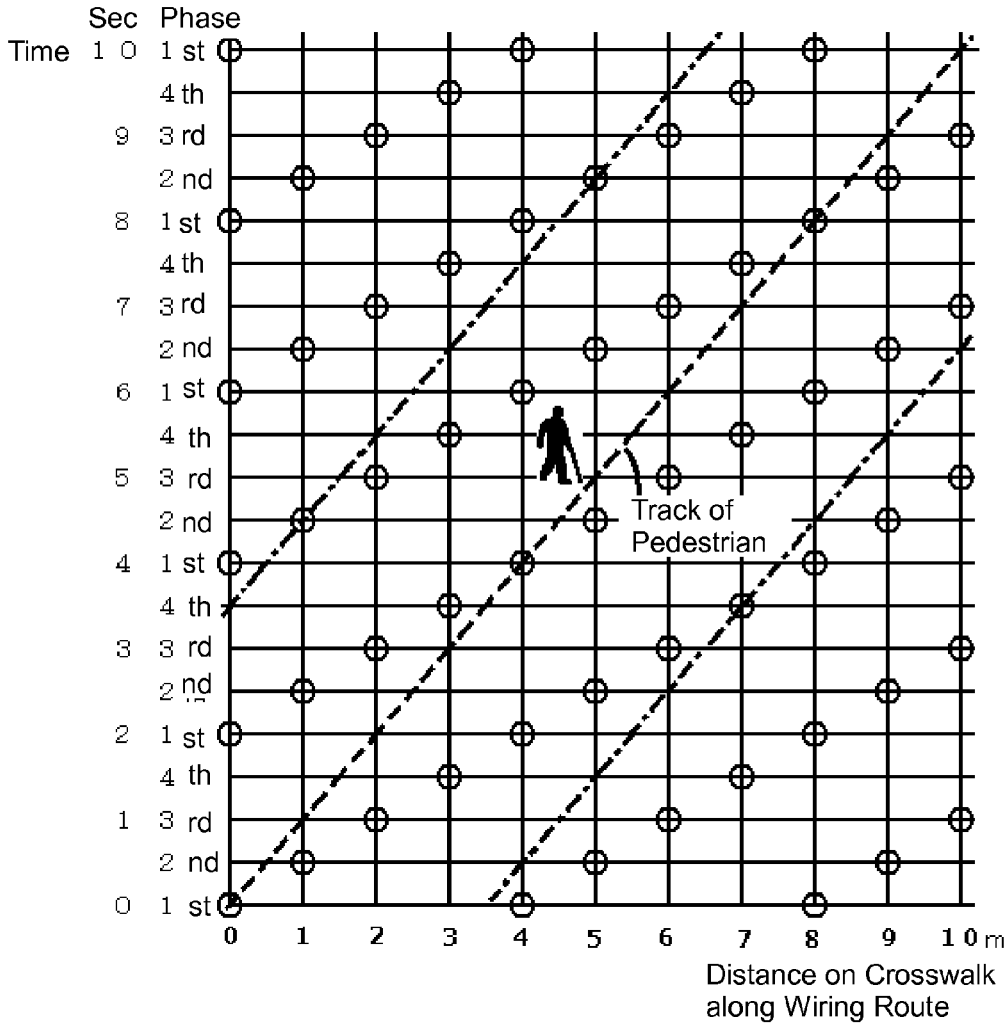
FIG. 4 shows, with FIG. 5, a reason why the signal sound of this acoustic signal makes a pedestrian feel to hear birds singing and flying.
Figure 5:
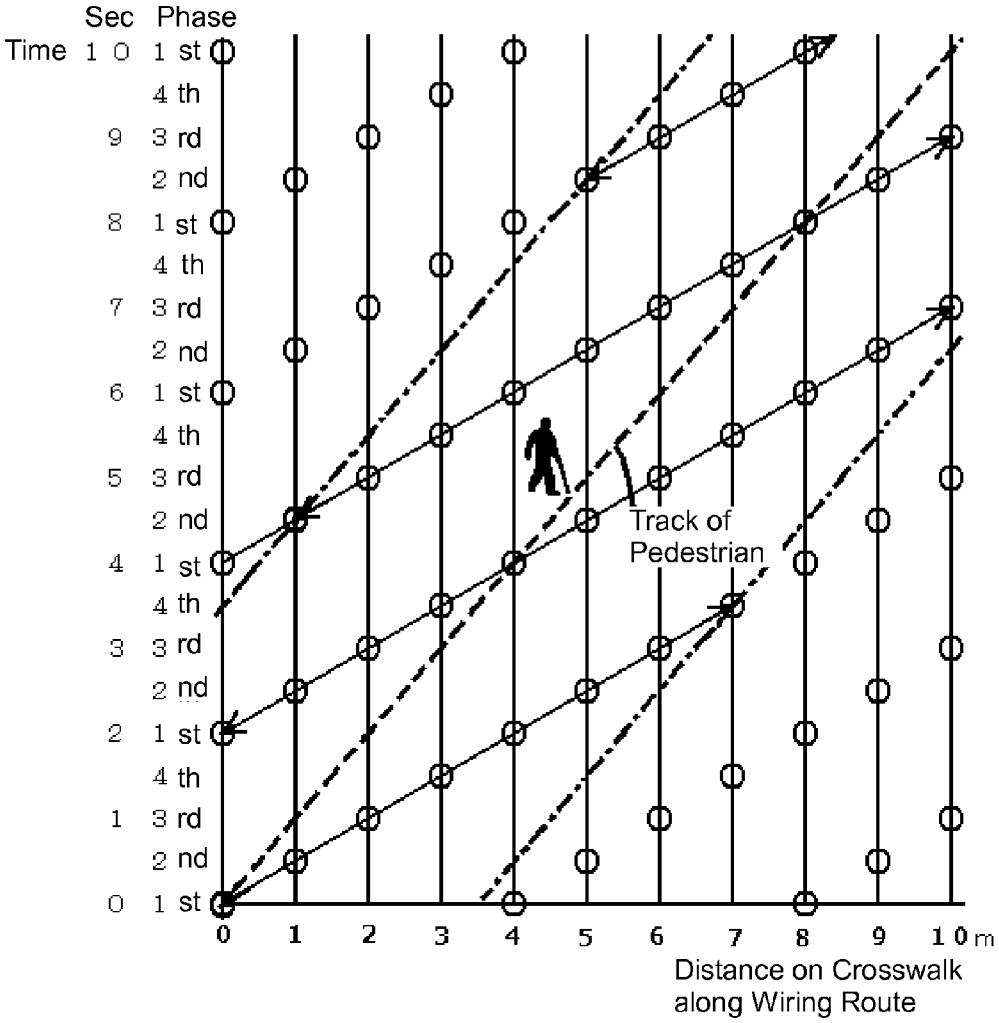
FIG. 5 shows pedestrian hearable signal sound generated points connected in time sequence, when the same signal sound as FIG. 4 are generated. A pedestrian would hear the signal sound generated points moving in this sequence.

FIG. 4 is a timing chart of the guiding system to explain with FIG. 5 that the pedestrian hearing the signal wave feels a series of singing birds flying and passing. The horizontal axis shows the distance on the crosswalk from the start. The route length is 10 m. The vertical axis shows the time by phase number 1 to 4. The time delay between phases is 0.5 s. The broken arrow line from the origin to right upper end shows the track of a pedestrian walking at a speed of 1 m/s. The circle shows the point of time and distance producing the signal sound "cheep". As in FIG. 4, when time is 0 at the start, 3 speakers denoted with the circle are placed at 0 m, 4 m, 8 m in the first phase line, and they produce the sound. At the next moment, time is 0.5 s and 3 speakers in the second phase line are placed at 1 m, 5 m, 9 m with a spacing of 1 m to those in the first phase and they produce the sound. At the next moment, time is 1.0 s and 3 speakers in the third phase line are placed at 2 m, 6 m, 10 m with a spacing of 1 m to those in the second phase and they produce the sound. At the next moment, time is 1.5 s and 2 speakers in the fourth phase line are placed at 3 m, 7 m, with a spacing of 1 m to those in the third phase and they produce the sound. At the next moment, time is 2.0 s and 3 speakers in the first phase line again produce the sound. The operation is repeated thereafter. If we assume the pedestrian can hear the signal sound only from the distance less than 3.5 m, the audible speakers are inside of the two chain lines. The two chain lines are written at the position of the broken line shifted by 3.5 m to right and to left.

FIG. 5 is a timing chart similar to FIG. 4. The oblique arrow lines connecting the circles show the tracks on which the pedestrian hears and feels a bird were flying. When time is 0 at the start, the speaker at distance Om on the first arrow produces the sound "cheap". At the next moment time is 0.5 s, the speaker on the first arrow at distance 1 m produces "cheap". The sound "cheap" is produced one by one along the first arrow. This wave of sound imitates a bird's cheeping that flies at the speed of v=d/t=2 m/s from the origin along the signal wiring route. Therefore the pedestrian feels as that a cheeping bird is flying. When the bird actually flies, the Doppler effect is added to the sound. But we can neglect the difference due to the effect. For the next arrow also a wave of sound imitating a cheeping bird of the same speed is made on the arrow. At the intersection point of the arrow and the broken line of the pedestrian's track, the bird passes over the pedestrian where the distance is 4 m. For the third arrow a cheeping bird passes over the pedestrian at the distance of 8 m. The virtual birds fly periodically. The period T is T=nt=2 s. The distance D from a bird to the next is D=nd=4 m where the number of phases is 4. If the distance D is too large and D/2 exceeds the distance that the sound can reach, the pedestrian cannot hear the signal in some part. If D is small, the loudness of the signal, which may induce the noise trouble to the adjacent resident, can be reduced. The height of the signal wiring must be higher not to disturb the cars that go under it than the height of the cars. If it is not possible for speakers to be placed over the center part of the road, directional speakers may be used for reducing the noise trouble to adjacent people.

Figure 6:
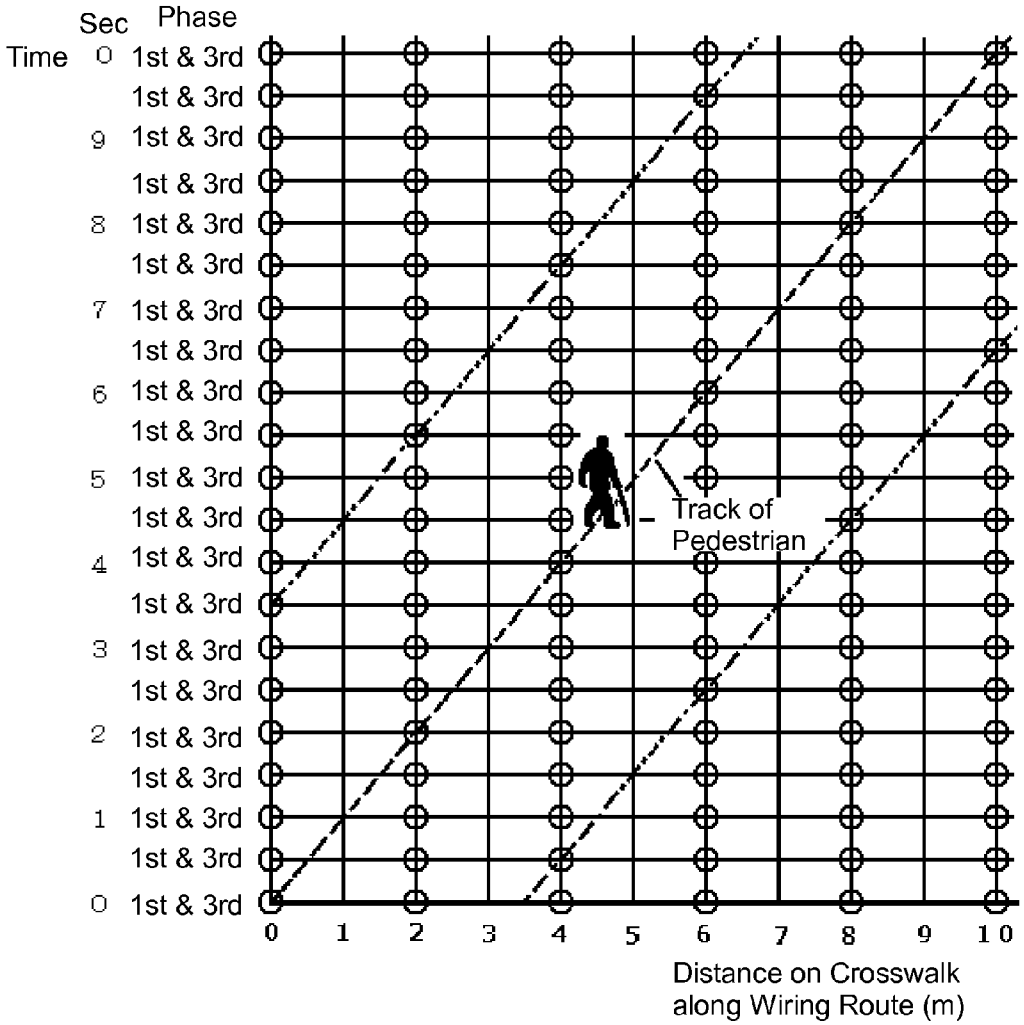
FIG. 6 explains, with FIG. 7, an operation of the acoustic signal when the traffic light of the crosswalk is red. It explains a reason why the signal sound is heard as singing birds are staying at the traffic light being red. In this case, the signal sound is sent to only phase #1 and phase #3.
Figure 7:
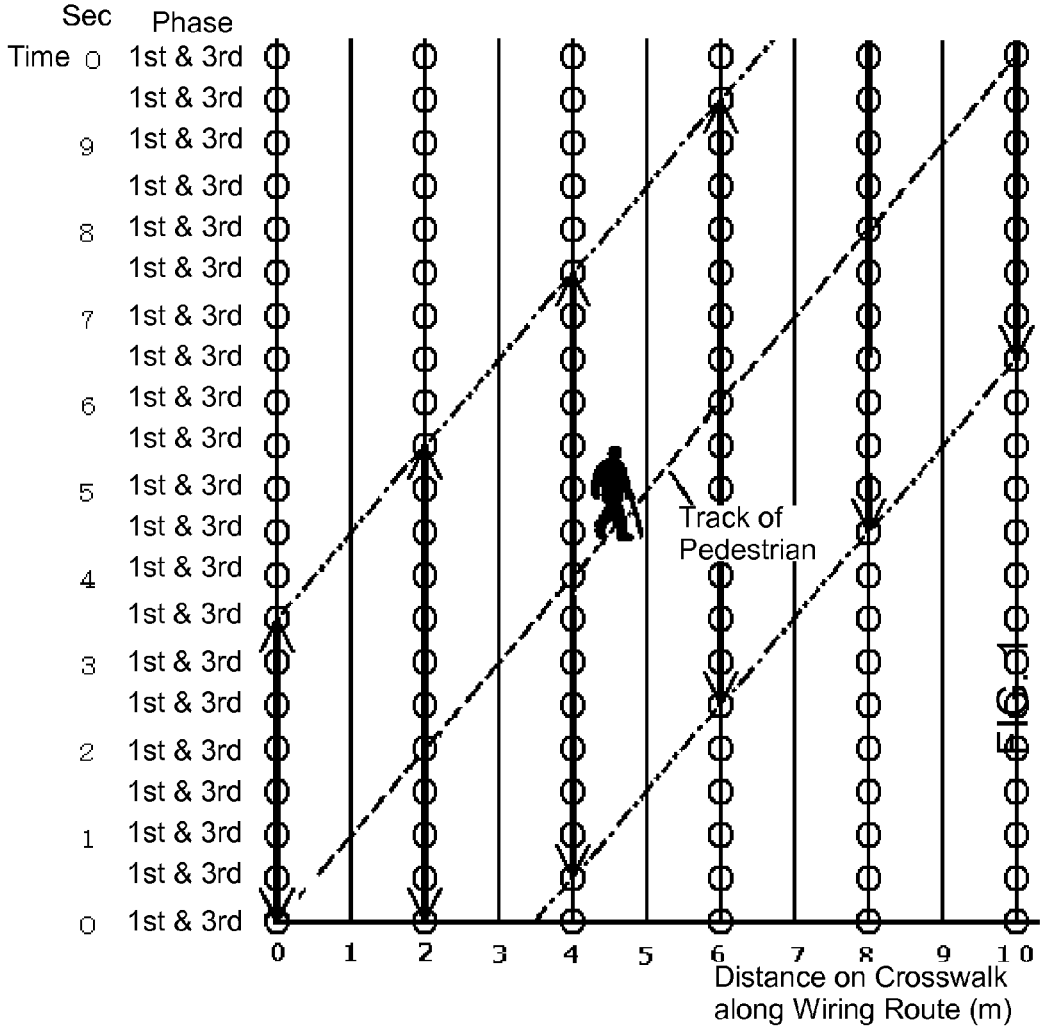
FIG. 7 shows pedestrian hearable signal sound generated points connected in time sequence, when the same signal sound as FIG. 6 is generated. A pedestrian would hear the signal sound generated points being at a standstill because the signal sound generated points do not move.

FIG. 4 and FIG. 6 show a timing chart for the distributer 2 to supply the signal wave form from the sound source 1 to each of the n phase lines. The circle at a distance in the horizontal axis shows that the sound signal is supplied to the line of which phase number is denoted in the vertical axis and the speaker produces the signal sound at that time. The period of the clock signal to make the sound source 1 generate the wave form is t. The wave length of the signal D is given by D=nd. The speed of the signal wave v is given by v=D/T where T is the period of the signal wave, FIG. 6 and FIG. 7 show a timing chart when the traffic light of the crosswalk is red. In FIG. 6, the wave form current of "tweet" from the sound source 1 is sent only to the lines phase #1 and phase #3 by the distributer 2. No wave form current is sent to the lines phase #2 and phase #4. We assume the pedestrian can hear the signal sound inside of the two chain lines. FIG. 7 shows a timing chart similar to FIG. 6. The vertical lines connecting the circles show the tracks of the singing birds which keep staying though the time goes. In this case, the signal wave is a standing wave which is the superposition of a progressive-wave of v=2 d/t and a regressive-wave of v=−2 d/t. In addition to these signal wave, the half speed wave by the timing chart having the phase sequence 1, 1, 2, 2, 3, 3, . . . can be used for the yellow light signal. During the traffic signal is red, if the traveling speed of the signal wave is zero, the pedestrian may lose the sense of direction. So the quarter speed wave signal may be used instead of the standing wave.

To use the half speed wave or the quarter wave, the phase number is given by the formula below. The clock time t is kept constant as a too long clock time is not adequate for guiding. And we do not change the number of phases n or the spacing of the speakers d, when the signal wiring is already placed. We can change the timing chart by software. The clock pulse number k increases as k=1, 2, . . . with the elapsed time. When the controller generates clock pulse k, the wave form signal is supplied to the phase p line and the sound is produced, where p is given by:

$$p=(tv/d)k.$$

When v=d/t, the expression becomes to p=k, and p goes as p=1, 2, 3, . . . , 6 along with k=1, 2, 3, . . . , 6, which makes the timing chart of FIG. 4. When the wave speed is decreased to v=0.5 d/t, the expression becomes to p=0.5 k, and the phase number that produces sound goes as p=0.5, 1, 1.5 2, 2.5, 3. But the phase number p must be an integer, so p becomes 1, 1, 2, 2, 3, 3 by rounding up and it becomes 0, 1, 1, 2, 2, 3 by rounding down. As the round up and the round down give different results, a simple solution is to take one and neglect the other or to supply both of them. The wave length of this wave is the same D=nd, but the period becomes double, that is, T=2nd.

On the contrary, when the traffic light is yellow the clock speed may be increased to hurry to finish crossing. The voice information like "The signal is changed." or "The signal is changing soon." may be supplied when necessary.

Embodiment 2

Figure 8:
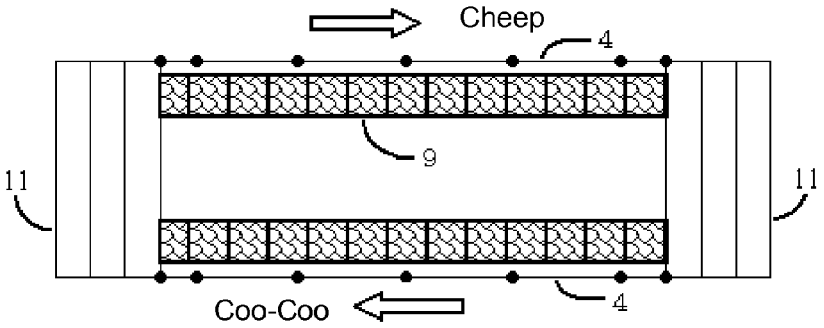
FIG. 8 shows a plan view of a platform of a railroad station of the second embodiment of the present invention. Two signal lines 4 are provided at the both sides of the platform. The black dots show speakers. A signal wiring denoted by the arrow pointing right is for a signal sound "cheep" to move to right. A signal wiring denoted by the arrow pointing left is for a signal sound "coo-coo" to move to left.

FIG. 8 shows a plan view of a platform of a railroad station in which an acoustic guiding system is placed to prevent fall accidents. There are two signal wirings 4 at the both side edges of the platform along the route of the embedded block tiles 9 that parallel to the railroad. The black dots on the wirings are speakers. The white arrow pointing right on the upper wiring shows that birds singing "cheep" moves to right and the white arrow pointing left on the lower wiring shows that the birds singing "coo-coo" moves to left. When the end of the platform is linked to stairs 11, the signal wiring can be placed continued to the stairway and the route of the wiring can be bent up or down at the access to the stairs to notify the position. This system is useful to notify the general direction and dangerous area boundaries in the platform to the pedestrians.

Embodiment 3

Figure 9:
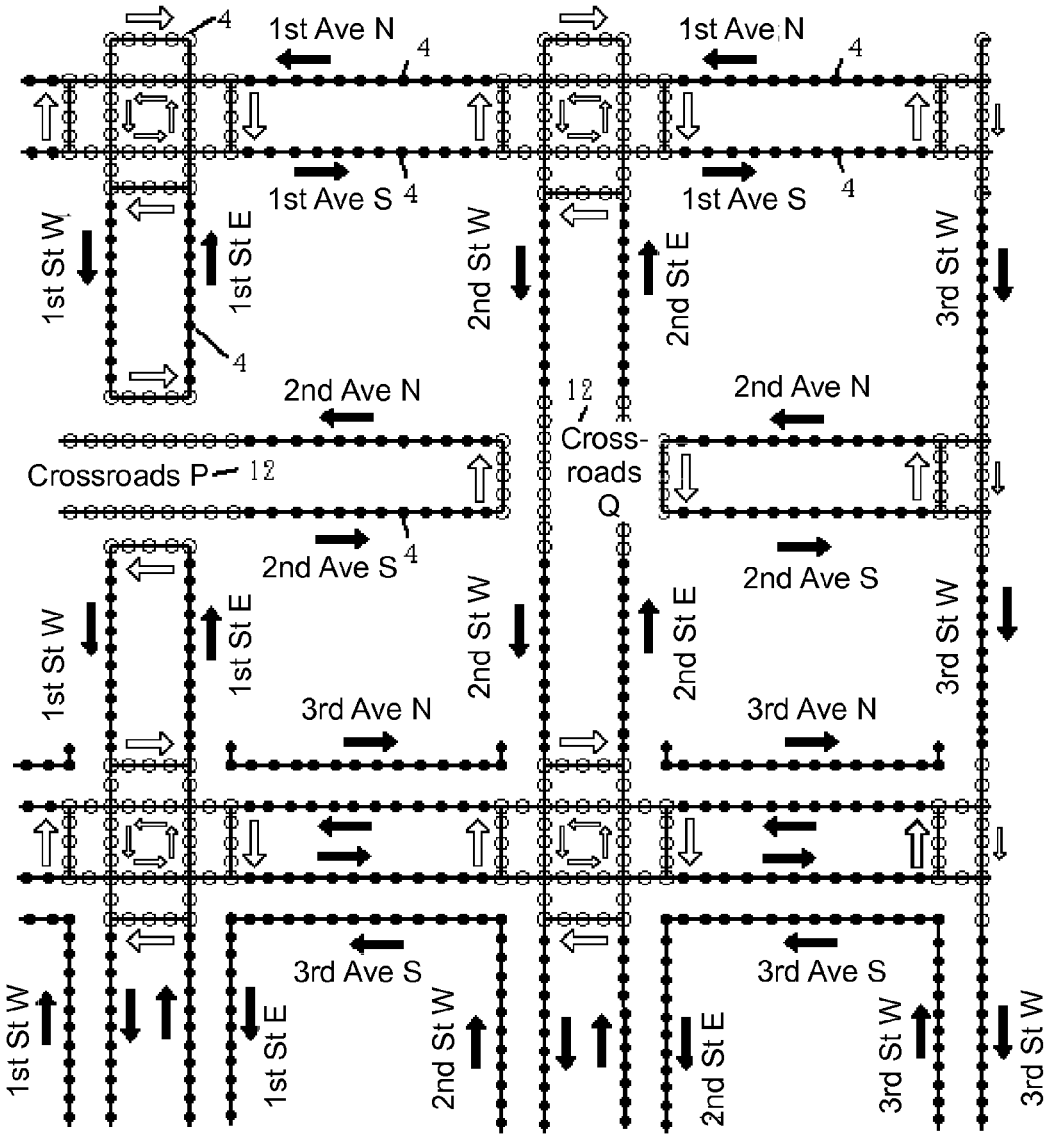
FIG. 9 shows a plan view of a system of the third embodiment of the present invention applied on streets. It shows a part of a district where roads lie in the east-west direction and in the south-north direction. The signal wirings 4 are placed in all of the roads at side walk boundaries and at crossroads. On the crossroads, speakers denoted by the white circles on the wirings at the crossroads are placed and signal sounds move along the white arrow directions. In the roads except the crossroads, signal wirings denoted by the black arrows and speakers denoted by the black dots are placed. At each crossroads, it is controlled with synchronizing to the red and blue light of the traffic signal. As examples, a crossroads P is shown as a crossing of the second street and the first avenue and a crossroads Q is shown as a crossing of the second street and the second avenue.

FIG. 9 shows a plan view of a part of a district having the present invention guiding system. The avenues First, Second and Third lie in the south-north direction and the streets First, Second and Third lie in the east-west direction. The signal wirings 4 are placed in all the road at the side walk boundary and at the crossroads.

The white circles on the wirings at the crossroads denote speakers and the signal wave moves in the white arrow direction. In the roads except the crossroads, the signal wirings are placed and the black dots on the wirings denote the speakers and the signal wave always moves in the black arrow direction. The street and avenue name may be included in the signal sound. At the crossroads, there are four vertical wirings and four horizontal wirings. The signal wirings control is synchronized to the red and green light of the traffic signal. For example, the second street is permitted to walk in the crossroads P on the first avenue and the second avenue is permitted to walk in the crossroads Q on the second street. When the traffic signal is green, the four wirings in that direction produce the sound signal for permission to cross and the four wirings in the perpendicular direction produce the sound signal for non-permission. For instance the quarter speed wave signal may be used. In the roads except the crosswalks, the signal wirings are placed and the black dots on the wirings denote speakers and the signal wave always moves in the black arrow direction. The street and avenue name may be included in the signal sound. Those names are helpful for road signs.

In this embodiment, the pedestrian road is completely surrounded by the signal wiring placed at the boundary of the pedestrian road and car road. The signal wave moves clockwise on the boundary around the safe region. When the pedestrian is following the signal wave, the left hand side of the wiring on the boundary is the safe region. By designing always an acoustic guiding system based on this rule, we can establish the rule that the left hand side of the wiring on the boundary is the safe region, when the pedestrian is following the signal wave, similar as the rule of the road "keep to the left" (right in some country or region). By this rule, the pedestrian can always walk in the left hand side of the signal wiring toward the direction the wave signal goes to. If the pedestrian hears the signal sound in the left hand side, that is a warning that he/she is in the dangerous zone. In the pedestrian road the signal wiring is placed on the car road boundary only, so the visually impaired will walk along the boundary. But this may make a trouble with a bicycle, if a bicycle is allowed to go on the road. A safer system can be made as shown in the south side district of the south side walk of Third street, by placing the signal wiring on the both side edges of all the pedestrian walks. Then the pedestrian can walk the right side of the wiring placed along the left side edge of the side walk. These are general principle. The design based to the actual district should be made to place the practical system. Visually impaired persons get a large freedom of activity and their welfare is greatly improved by this method.

The invention claimed is:

1. An acoustic guiding system comprising:

an n-phase signal wiring which contains n wire lines and a common ground where n is an integer larger than or equals to three;

a sound source which generates an electric current wave form for a signal sound;

a distributer which distributes the electric current wave form from the sound source to each line of the n-phase signal wiring repeatedly;

speakers which are connected to each line of the n phase signal wiring in the order of the phase number periodically with a certain spacing each other and each of which produces the signal sound; and a controller which gives an instruction signal to the sound source and the distributer to control the signal sound to be produced by the speakers for controlling traffic, warning to pedestrians or guiding the pedestrians.

2. The acoustic guiding system according to claim 1 in which: the signal sound produced by the speakers imitates a series of flying and singing birds along the route.

3. The acoustic guiding system according to claim 2 in which: the signal sound imitates that when one singing bird goes on, next singing bird follows the same route.

4. The acoustic guiding system according to claim 1 in which: the signal sound forms a wave of sound producing points moving along the route.

* * * * *